US007942347B2

(12) United States Patent
Huang

(10) Patent No.: US 7,942,347 B2
(45) Date of Patent: May 17, 2011

(54) SPRINKLER HAVING OSCILLATING MECHANISM

(75) Inventor: Chen Tung Huang, Taichung (TW)

(73) Assignee: Yuan Pin Industrial Co., Ltd., Changhua Hsien (TW)

( * ) Notice: Subject to any disclaimer, the term of this patent is extended or adjusted under 35 U.S.C. 154(b) by 585 days.

(21) Appl. No.: 12/006,339

(22) Filed: Jan. 2, 2008

(65) Prior Publication Data

US 2009/0166446 A1 Jul. 2, 2009

(51) Int. Cl.
*B05B 1/30* (2006.01)

(52) U.S. Cl. ..... 239/581.1; 239/237; 239/240; 239/263.3; 239/242; 239/582.1

(58) Field of Classification Search ..... 239/263.3, 239/237, 239, 240, 381, 581.1, 581.2, 582.1
See application file for complete search history.

(56) References Cited

U.S. PATENT DOCUMENTS

| | | | | |
|---|---|---|---|---|
| 2,942,789 | A * | 6/1960 | Smith | 239/239 |
| 5,033,678 | A * | 7/1991 | Borghese et al. | 239/242 |
| 7,226,000 | B2 | 6/2007 | Huang | 239/242 |
| 2006/0102751 | A1 * | 5/2006 | Heren et al. | 239/451 |
| 2006/0157583 | A1 * | 7/2006 | Huang | 239/242 |

* cited by examiner

*Primary Examiner* — Dinh Q Nguyen

(57) ABSTRACT

A sprinkler includes an oscillating mechanism having a receptacle for receiving a water, and a casing rotatably attached to the receptacle. A device may be used for swinging the casing relative to the receptacle in reciprocating action, to allow the water to smoothly or swiftly flow out of the sprinkler tube in various kinds of water spraying patterns. Two ratchet gears are rotatably received within the receptacle and rotated in different directions, a barrel and a shaft are rotatably received within the receptacle and rotated in different directions, and a valve controlling device may be used for controlling the water to flow through the shaft, such as to flow through the shaft intermittently.

11 Claims, 9 Drawing Sheets

SPRINKLER HAVING OSCILLATING MECHANISM

BACKGROUND OF THE INVENTION

1. Field of the Invention

The present invention relates to a sprinkler, and more particularly to a sprinkler having an oscillating mechanism for smoothly rotating or driving the sprinkler tube and having a control valve device to control the water flowing through a central shaft of the sprinkler.

2. Description of the Prior Art

Typical sprinklers comprise a sprinkler tube including one end coupled to a water reservoir for receiving the water from the water reservoir, and the other end having one or more openings for allowing the water to flow out of the sprinkler tube in various kinds of water spraying patterns, an impeller for rotating or swinging the sprinkler tube in reciprocating action, and having a heart-shaped cam member driven by a driving shaft, for engaging with a laterally extended pivot member, and thus for swinging the sprinkler tube in reciprocating action when the heart-shaped cam member is continuously rotated by the driving shaft.

However, the heart-shaped cam member may include a central recess and an opposite arcuate projection which may also be engaged with the driving shaft, and which may have a good chance to form two dead points between the heart-shaped cam member and the driving shaft.

The present applicant has developed another typical sprinkler issued as U.S. Pat. No. 7,226,000, to Huang, and including an oscillating mechanism for smoothly rotating or driving the sprinkler tube.

However, there is no control valve device to control the water flowing through the central shaft.

The present invention has arisen to mitigate and/or obviate the afore-described disadvantages of the conventional oscillating mechanism for the sprinklers.

SUMMARY OF THE INVENTION

The primary objective of the present invention is to provide a sprinkler including an oscillating mechanism for smoothly rotating or driving the sprinkler tube and for avoiding dead points to be occurred, and thus for allowing the water to smoothly or swiftly flow out of the sprinkler tube in various kinds of water spraying patterns.

The other objective of the present invention is to provide a sprinkler including a control valve device to control the water flowing through the central shaft.

In accordance with one aspect of the invention, there is provided a sprinkler comprising an oscillating mechanism including a receptacle for receiving a water, a casing rotatably attached to the receptacle and to be rotated relative to the receptacle, a first ratchet gear and a second ratchet gear rotatably received within the receptacle and rotated in different directions, the casing including two pawls selectively engaged with the first and the second ratchet gears respectively to allow the casing to be rotated relative to the receptacle in different directions by the pawls and the first and the second ratchet gears respectively, a barrel and a shaft rotatably received within the receptacle, and rotated in different directions, the first ratchet gear and the second ratchet gear being attached onto the barrel and the shaft respectively and rotated in concert with the barrel and the shaft respectively, and a valve controlling device for controlling the water to flow through the shaft.

The controlling device includes a valve opening formed in the shaft, and includes a rotary member rotatably attached to the shaft and having at least one orifice formed in the rotary member for selectively aligning with the valve opening of the shaft and for allowing the water to selectively flow through the orifice of the rotary member and the valve opening of the shaft and then to flow into a bore of the shaft.

The barrel and the shaft each include a first gear provided thereon, a paddle wheel is coupled to the barrel and the shaft for rotating the barrel and the shaft in different direction relative to the receptacle, the paddle wheel includes a pinion secured thereto and rotated in concert therewith, a reduction gearing engaged with the pinion and engaged with the first gear of the shaft, and at least one idle gear engaged between the first gear of the barrel and the reduction gearing for allowing the barrel and the shaft to be rotated in different direction relative to the receptacle by the paddle wheel.

The rotary member includes a second gear engaged with the reduction gearing for allowing the rotary member to be rotated by the reduction gearing and the paddle wheel. The rotary member includes a rod extended therefrom, and the second gear is disposed on the rod. The receptacle includes a container having a partition and a board to form a compartment therein and between the partition and the board and for rotatably receiving the paddle wheel therein.

The shaft includes a valve piece having the valve opening formed in the valve piece. The shaft includes a peripheral shoulder formed therein and formed by an outer peripheral wall for receiving and engaging with the valve piece.

The shaft includes a notch formed in the outer peripheral wall, and the valve piece includes a key extended therefrom for engaging with the notch of the shaft and for anchoring the valve piece to the shaft and for preventing the valve piece from being rotated relative to the shaft. The shaft includes at least one bulge extended into the valve opening thereof for selectively aligning with the orifice of the rotary member.

The casing includes a plate having the pawls each of which includes a first end for engaging with the first and the second ratchet gears respectively. The casing includes a spring member engaged with the pawls, for biasing the first ends of the pawls to engage with the first and the second ratchet gears respectively.

The casing includes an actuating device rotatably attached to the plate with a pivot axle, and includes two legs for engaging with the pawls and for forcing the first ends of the pawls to selectively engage with the first and the second ratchet gears respectively. The casing includes a swelling extended therefrom, the actuating device includes a spring biased projection engaged therein, and engaged with the swelling of the casing, for selectively positioning the first ends of the pawls in engagement with the first and the second ratchet gears respectively.

The receptacle includes a first control ferrule and a second control ferrule attached to the receptacle, and each having an actuator extended therefrom for engaging with the actuating device, and for selectively forcing the first ends of the pawls to engage with the first and the second ratchet gears respectively.

The receptacle includes a pin extended therefrom, the first and the second control ferrules each includes a curved channel formed therein, for slidably receiving the pin of the receptacle, and for limiting the first and the second control ferrules to rotate relative to the receptacle.

The receptacle includes a sleeve extended therein, the first and the second control ferrules each includes a serrated surface formed therein, for engaging with the sleeve with a force-fitted engagement.

The control ferrules each includes a knob extended outwardly therefrom, for allowing the first and the second control ferrules to be rotated and adjusted relative to the receptacle by users, in order to determine a rotating and swinging stroke of the casing and the sprinkler tube relative to the receptacle.

The first control ferrule includes a curved slot formed therein, for slidably receiving the actuator of the second control ferrule, and for allowing the actuator of the second control ferrule to engage with the actuating device.

The barrel and the shaft each includes a non-circular segment provided thereon for engaging with the first and the second ratchet gears respectively, and for allowing the first and the second ratchet gears to be rotated in concert with the barrel and the shaft respectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
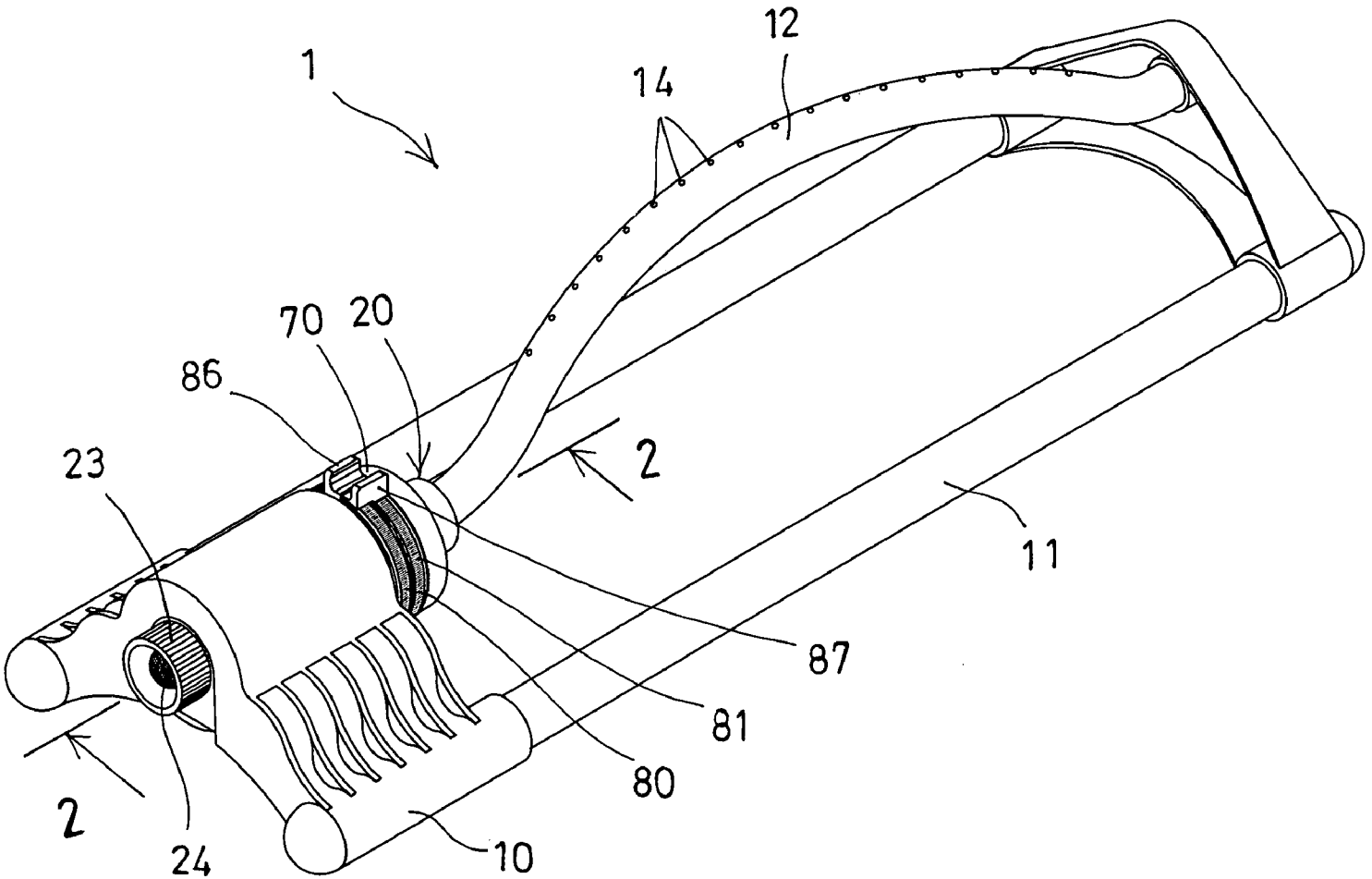
FIG. 1 is a perspective view of a sprinkler in accordance with the present invention.

Referring to the drawings, and initially to FIG. 1, a sprinkler 1 in accordance with the present invention comprises a housing 10 attached or disposed on one side of a runner assembly or a base 11, for receiving and supporting an oscillating mechanism 20 therein, and a sprinkler tube 12 coupled to the oscillating mechanism 20 and/or rotatably or swingably supported or attached to the base 11, for allowing the sprinkler tube 12 to be rotated relative to the housing 10 or the base 11 by the oscillating mechanism 20. The sprinkler tube 12 includes a number of perforations 14 formed therein, for allowing water to flow out through the perforations 14 of the sprinkler tube 12.

Figure 2:
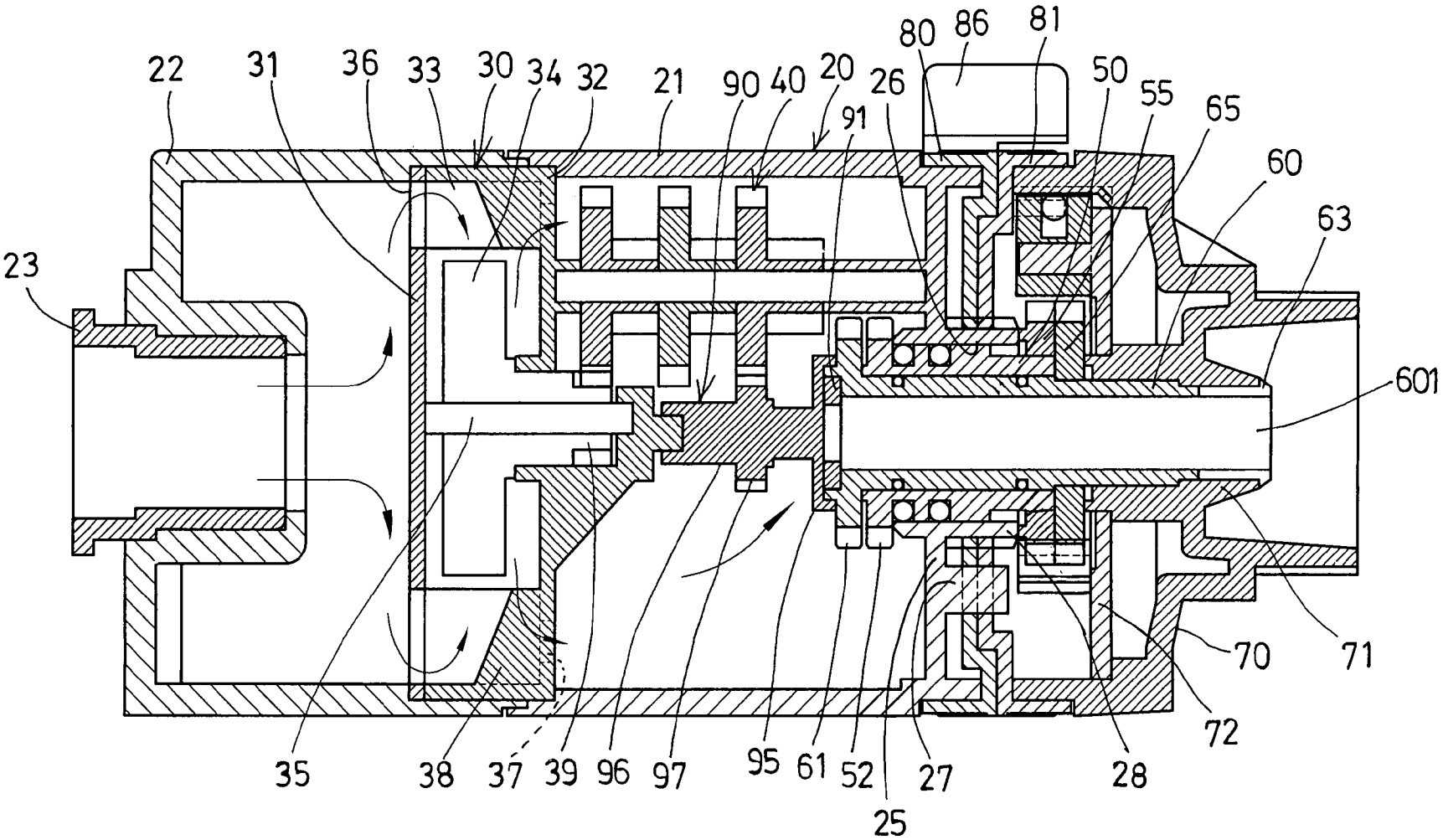
FIG. 2 is a partial cross sectional view of the sprinkler, taken along lines 2-2 of FIG. 1.
Figure 3:
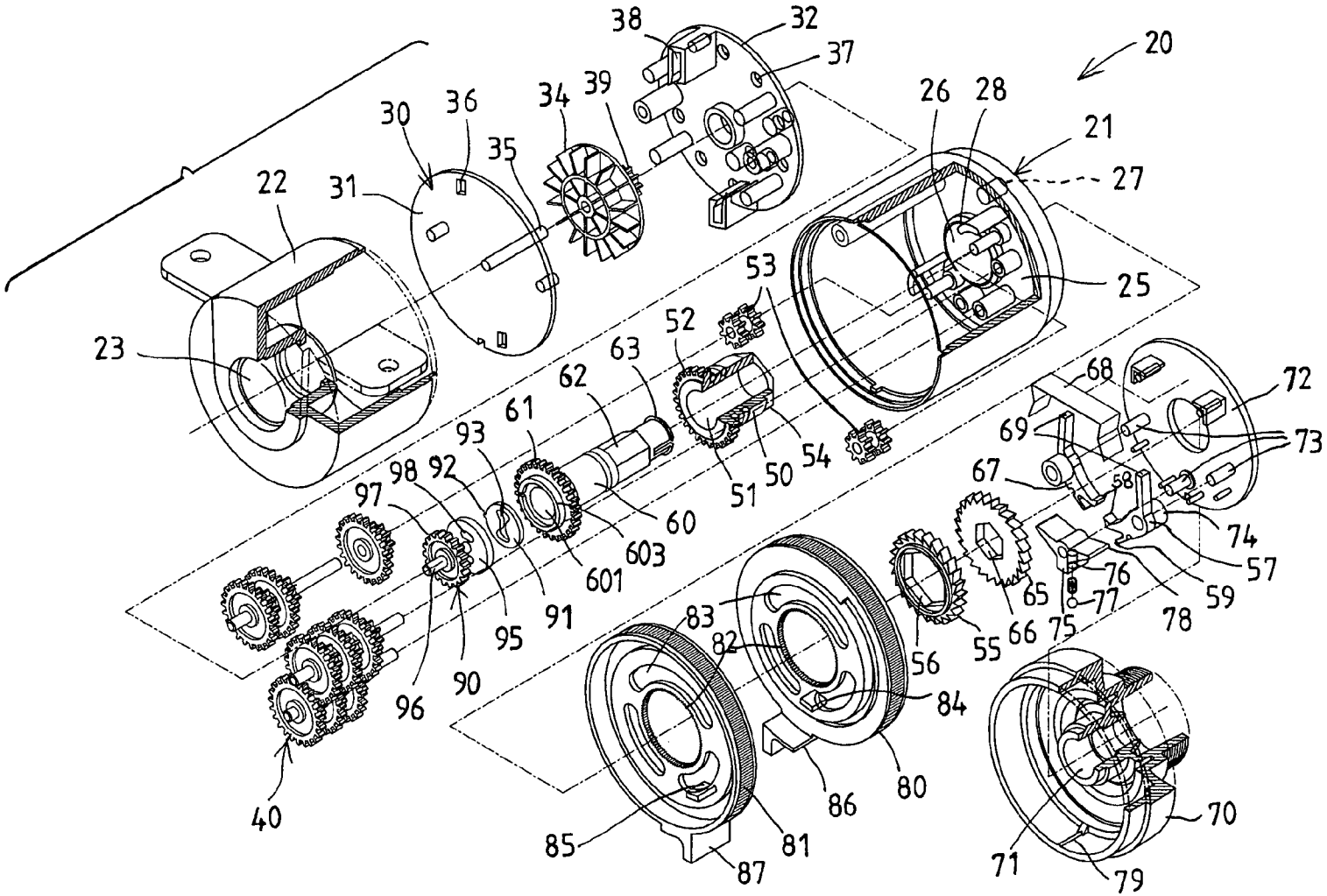
FIG. 3 is a partial exploded view of the sprinkler.
Figure 4:
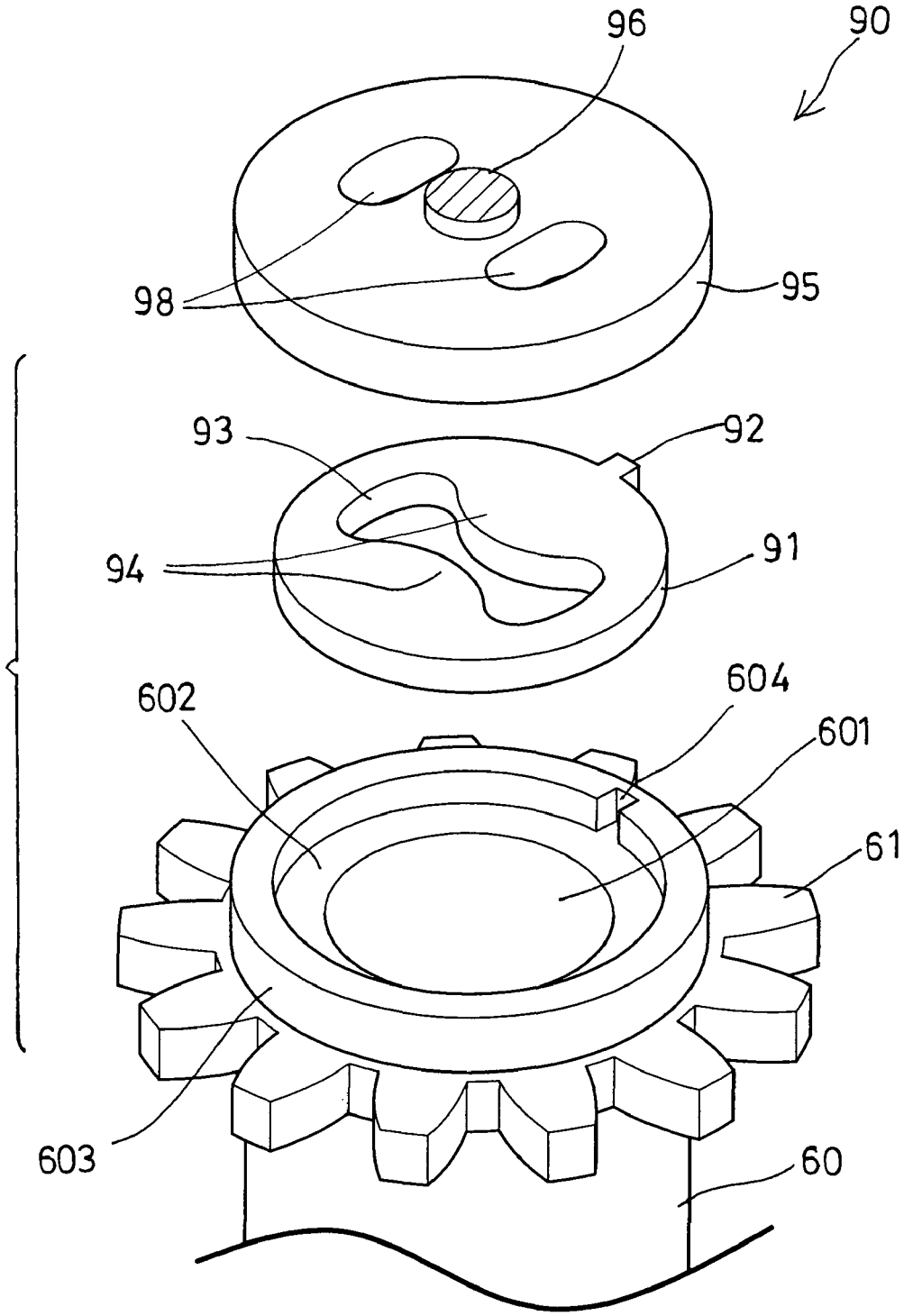
FIG. 4 is another partial exploded view illustrating a control valve device of the sprinkler.

Referring next to FIGS. 2-4, the oscillating mechanism 20 includes a receptacle 21 disposed or received or secured within the housing 10, and having an extension or receptacle member 22 attached or secured to one side of the receptacle 21, the receptacle member 22 may also be formed integral with the receptacle 21, and may be one part of the receptacle 21. The receptacle member 22 includes a port 23 provided thereon or coupled thereto, and extended out of the housing 10 (FIG. 1).

The port 23 of the receptacle member 22 or the receptacle 21 may be coupled to a water reservoir, for allowing the water to flow into the receptacle member 22 and the receptacle 21, and then to flow out of the sprinkler tube 12, which will be discussed in further details hereinafter. It is preferable that a filter screen 24 is further provided and disposed within the port 23 of the receptacle member 22 or the receptacle 21 (FIG. 1), for filtering the water, and for preventing particles or dirt from flowing into the receptacle member 22 and the receptacle 21.

A container 30 is provided or disposed within the receptacle member 22 or the receptacle 21, and includes such as a partition 31 and a board 32 attached or secured within the receptacle member 22 or the receptacle 21, for forming a compartment 33 therein or between the partition 31 and the board 32 (FIG. 2), and for rotatably receiving a paddle wheel 34 therein. For example, the paddle wheel 34 may be rotatably attached to the container 30, or may be secured between the partition 31 and the board 32 with such as a pivot spindle 35.

The partition 31 of the container 30 includes one or more inlets 36 formed therein, and directed toward the paddle wheel 34, for guiding the water to continuously rotate or to drive the paddle wheel 30. The board 32 of the container 30 may also include one or more holes 37 formed therein and/or one or more guide members 38 attached thereto, and directed toward the paddle wheel 34, for further guiding the paddle wheel 34 to be continuously rotated or driven by the water.

The paddle wheel 34 includes a pinion 39 secured thereto and rotated in concert therewith, and the pinion 39 is engaged with a reduction gearing 40 which may be disposed and supported within the receptacle 21, for allowing the reduction gearing 40 to be rotated or driven by the paddle wheel 34. The receptacle 21 includes one side panel 25 provided thereon and spaced away from or distal to the container 30, and having a bore 26 formed therein and defined by a sleeve 28, and a pin 27 extended therefrom.

A barrel 50 is rotatably received or engaged within the bore 26 of the side panel 25 of the receptacle 21, and includes a bore 51 formed therein (FIG. 3) for rotatably receiving a shaft 60 therein. The shaft 60 includes a gear 61 provided thereon or secured thereto, and engaged with the reduction gearing 40, for allowing the shaft 60 to be rotated or driven by the reduction gearing 40. The shaft 60 further includes a non-circular segment 62 and one or more spring catches 63 provided thereon.

The barrel 50 also includes a gear 52 provided thereon or secured thereto, and engaged with the reduction gearing 40 indirectly via one or more idle gears 53, i.e., the idle gears 53 are engaged between the gear 52 and the reduction gearing 40, for allowing the barrel 50 to be rotated or driven by the reduction gearing 40 indirectly via the idle gears 53, and thus for allowing the barrel 50 and the shaft 60 to be rotated in different or reverse direction. The barrel 50 also includes a non-circular segment 54 provided thereon.

Two ratchet gears 55, 65 each includes a non-circular bore 56, 66 formed therein, for engaging with the corresponding non-circular segments 54, 62 of the barrel 50 and the shaft 60 respectively, for allowing the ratchet gears 55, 65 to be rotated in different or reverse direction by the barrel 50 and the shaft 60 respectively. The ratchet gears 55, 65 include ratchet teeth formed or provided thereon, and directed toward different directions, best shown in FIG. 3.

A casing 70 includes a hub 71 rotatably attached or engaged onto the shaft 60, and engaged with the spring catches 63 of the shaft 60 (FIG. 2), for rotatably attaching or securing the casing 70 to the receptacle 21, and for allowing the casing 70 to be rotated relative to the receptacle 21. The sprinkler tube 12 is coupled to the casing 70 and rotated in concert with the casing 70. The casing 70 further includes a plate 72 attached or secured therein and rotated in concert therewith, and disposed or located beside the ratchet gears 55, 65, best shown in FIG. 2.

Two pawls 57, 67 are rotatably attached or engaged onto the plate 72 with pivot axles 73 respectively, and each includes one end 58 for engaging with the ratchet gears 55, 65 respectively, and each further includes a limb 59 extended from the one end 58 thereof. A spring member 68 is attached or secured onto the plate 72, and is provided for engaging with the other ends 69 of the pawls 57, 67 respectively, and thus for biasing the one ends 58 of the pawls 57, 67 to engage with the ratchet gears 55, 65 respectively.

The pawl 57 includes a spacer 74 provided thereon and engaged with the plate 72, for separating or spacing the pawl 57 slightly away from the plate 72 and slightly away from the other pawl 67, and thus for allowing the pawls 57, 67 to be suitably engaged with the ratchet gears 55, 65 respectively, in order to allow the plate 72 to be selectively rotated by the ratchet gears 55, 65 via the pawls 57, 67 respectively.

An actuating means or member or device 75 is also rotatably attached or engaged onto the plate 72 with a pivot axle 73 (FIG. 3), and includes a cavity 76 formed therein for receiving a spring biased projection 77 therein, and includes two legs 78 for engaging with the pawls 57, 67 or for forcing the one ends 58 of the pawls 57, 67 to selectively engage with the ratchet gears 55, 65 respectively. The spring biased projection 77 may be engaged with a swelling 79 of the casing 70 (FIG. 3), for selectively positioning the one ends 58 of the pawls 57, 67 in engagement with the ratchet gears 55, 65 respectively.

In operation, when the one end 58 of the pawl 57 is forced to engage with the ratchet gear 55, the plate 72 may be rotated in one direction, such as counterclockwise by the ratchet gear 55. On the contrary, the plate 72 may be rotated in the other direction, such as clockwise by the other ratchet gear 65 when the one end 58 of the other pawl 67 is forced to engage with the ratchet gear 65, such that the plate 72 and thus the casing 70 and the sprinkler tube 12 may be rotated or swung in different direction by the ratchet gears 55, 65 respectively. Two control ferrules 80, 81 are further provided and attached or engaged onto the sleeve 28 of the receptacle 21, and each includes a number of teeth or a serrated surface 82 formed therein or provided thereon (FIG. 3), for engaging with the sleeve 28 with such as a force-fitted engagement, and for allowing the control ferrules 80, 81 to be secured or positioned on the sleeve 28 of the receptacle 21 at any suitable or selected angular position.

The control ferrules 80, 81 each includes a curved channel 83 formed therein, for slidably receiving the pin 27 of the receptacle 21, and thus for limiting the control ferrules 80, 81 to rotate relative to the receptacle 21; and each includes an actuator 84, 85 extended therefrom, for engaging with the actuating device 75, and thus for selectively forcing the one ends 58 of the pawls 57, 67 to engage with the ratchet gears 55, 65 respectively. The one ends 58 of both the pawls 57, 67 may also be disengaged from the ratchet gears 55, 65 when the actuating device 75 is engaged and positioned between the actuator 84, 85 of the control ferrules 80, 81. The control ferrules 80, 81 each includes a knob 86, 87 extended outwardly therefrom, for allowing the control ferrules 80, 81 to be rotated or adjusted relative to the sleeve 28 of the receptacle 21 by the users, in order to determine the rotating or moving or swinging stroke of the casing 70 and the sprinkler tube 12 relative to the receptacle 21.

In operation, when the one end 58 of the pawl 57 is forced to engage with the ratchet gear 55 by such as the actuator 84 of the control ferrule 80, the plate 72 may be rotated counterclockwise by the ratchet gear 55, until the actuating device 75 is engaged with the other actuator 85 of the control ferrule 81. The one end 58 of the other pawl 67 may then be forced to engage with the other ratchet gear 65 by the actuator 85 of the control ferrule 81, such that the plate 72 may then be rotated in the other direction, i.e., clockwise by the other ratchet gear 65 until the actuating device 75 is engaged with the actuator 84 of the control ferrule 80 again, such that the plate 72 and thus the casing 70 and the sprinkler tube 12 may be rotated or swung in different direction by the ratchet gears 55, 65 respectively and in reciprocating action by the ratchet gears 55, 65 alternatively.

When the actuating device 75 is engaged between the actuator 84, 85 of the control ferrules 80, 81, the actuating device 75 may be positioned centrally and the legs 78 of the actuating device 75 may force the one ends 58 of both the pawls 57, 67 to be disengaged from the ratchet gears 55, 65, such that the plate 72 and the casing 70 and the sprinkler tube 12 may be released, and such that the sprinkler tube 12 may be rotated freely by the water. The legs 78 of the actuating device 75 may be engaged with the limbs 59 of the pawls 57, 67, to make sure that the one ends 58 of both the pawls 57, 67 are disengaged from the ratchet gears 55, 65.

The above-described structure has been described in details in the prior sprinkler that was developed by the present applicant and issued as U.S. Pat. No. 7,226,000, to Huang, which may be taken as a reference for the present invention. The sprinkler 1 in accordance with the present invention further comprises a control valve device 90 to control the water flowing through the shaft 60, in which the shaft 60 includes a bore 601 formed therein (FIGS. 2-4), and includes a peripheral shoulder 602 formed in one end thereof and facing toward the board 32 (FIG. 2), and formed or defined by an outer peripheral wall 603 and communicating with the bore 601 of the shaft 60 for receiving or anchoring or engaging with a valve piece 91 therein. The shaft 60 further includes a notch 604 formed in the outer peripheral wall 603 and communicating with the peripheral shoulder 602 of the shaft 60.

The valve piece 91 of the control valve device 90 is engaged with or seated in the peripheral shoulder 602 of the shaft 60 and includes a key 92 extended radially and outwardly therefrom for engaging with the notch 604 of the shaft 60 and for anchoring the valve piece 91 to the shaft 60 and for preventing the valve piece 91 from being rotated relative to the shaft 60, and includes a valve opening 93 formed in the valve piece 91, and includes one or more (such as two opposite) protrusions or bulges 94 oppositely extended into the valve opening 93 for shaping or forming the valve opening 93 of the valve piece 91 into a substantially 8-shaped structure. A rotary member 95 is rotatably attached or engaged onto the valve piece 91 and the outer peripheral wall 603 of the shaft 60, and includes a rod 96 extended therefrom for engaging with the board 32 (FIG. 2) and for rotatably attaching or retaining the rod 96 and the rotary member 95 between the board 32 and the shaft 60.

Figure 6:
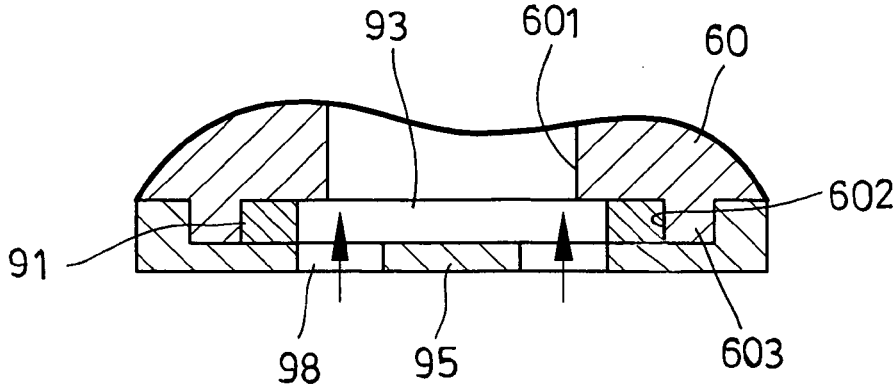
FIG. 6 is a partial cross sectional view taken along lines 6-6 of FIG. 5.
Figure 5:
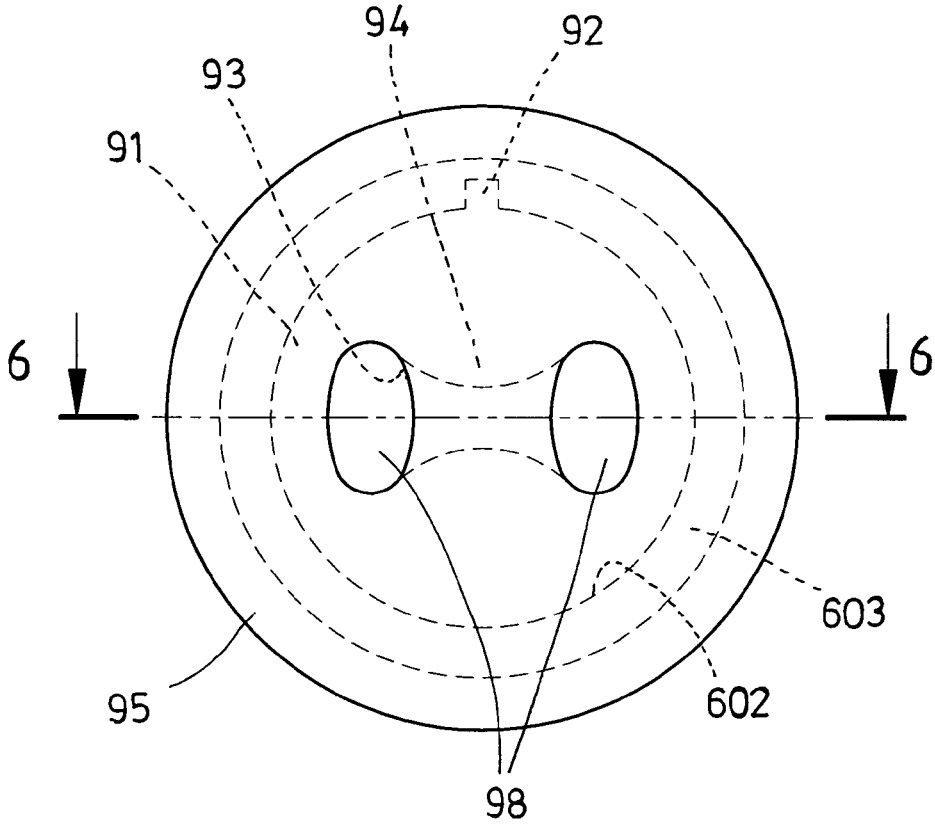
FIG. 5 is a plan schematic view illustrating the control valve device of the sprinkler.
Figure 8:
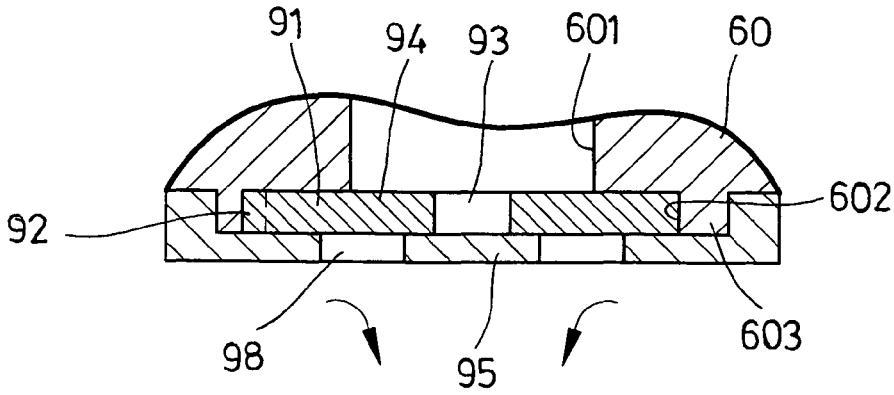
FIG. 8 is a partial cross sectional view taken along lines 8-8 of FIG. 7.
Figure 7:
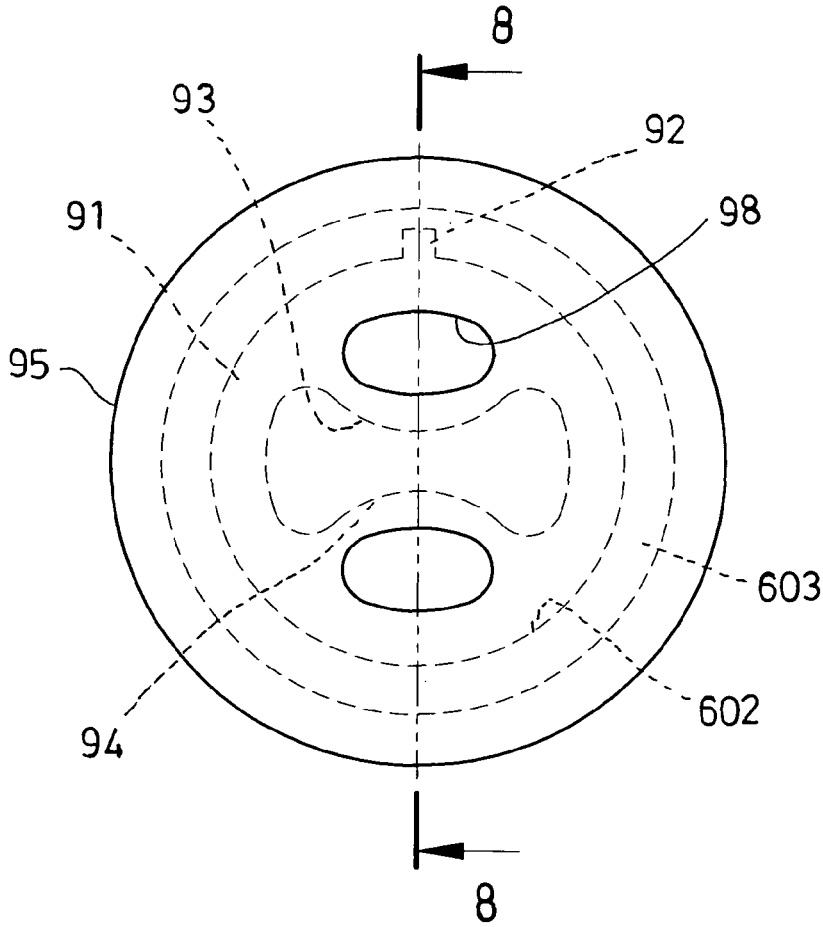
FIG. 7 is a plan schematic view similar to FIG. 5, illustrating the operation of the control valve device of the sprinkler.
Figure 9:
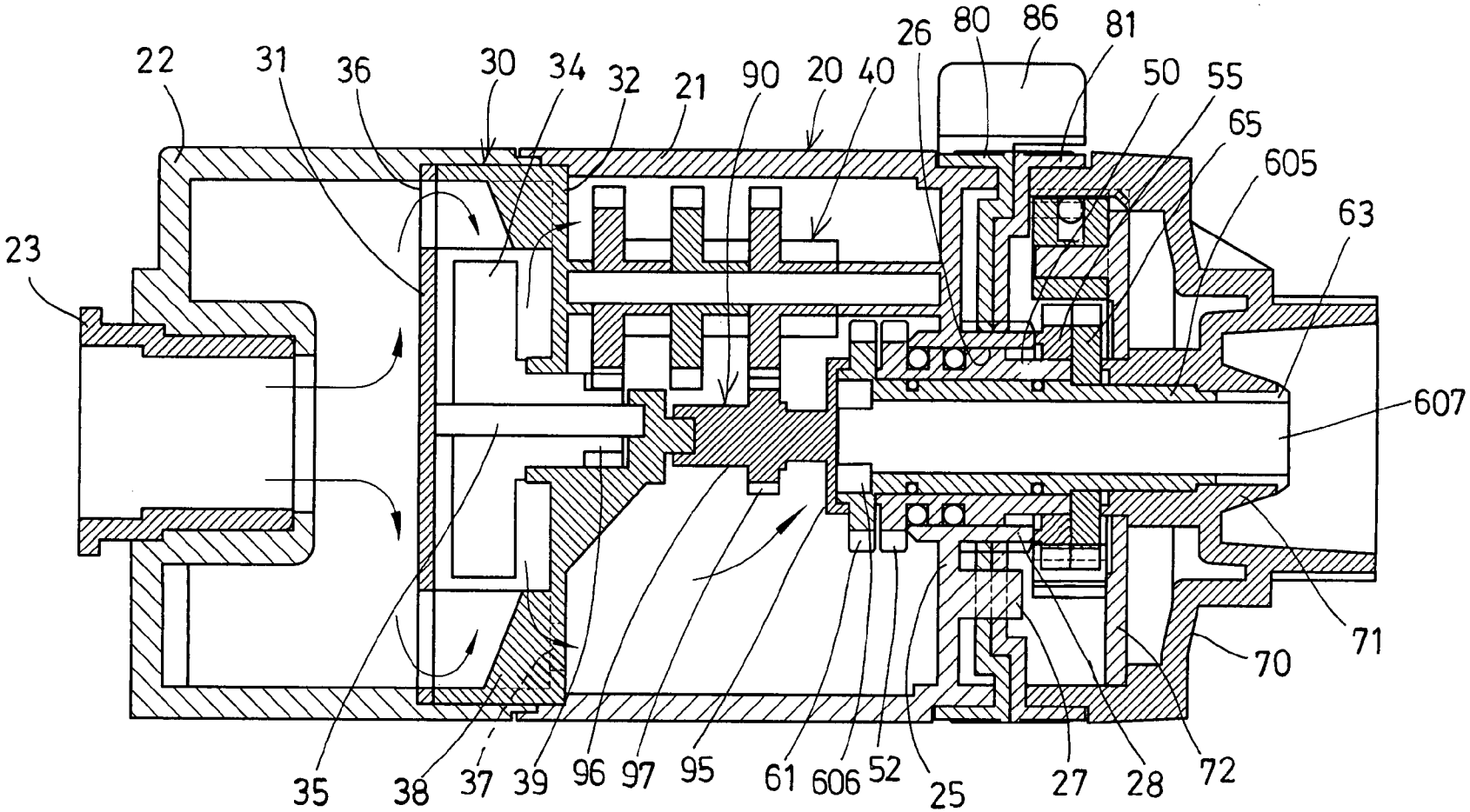
FIG. 9 us a partial cross sectional view similar to FIG. 2, illustrating the other arrangement of the sprinkler.
Figure 11:
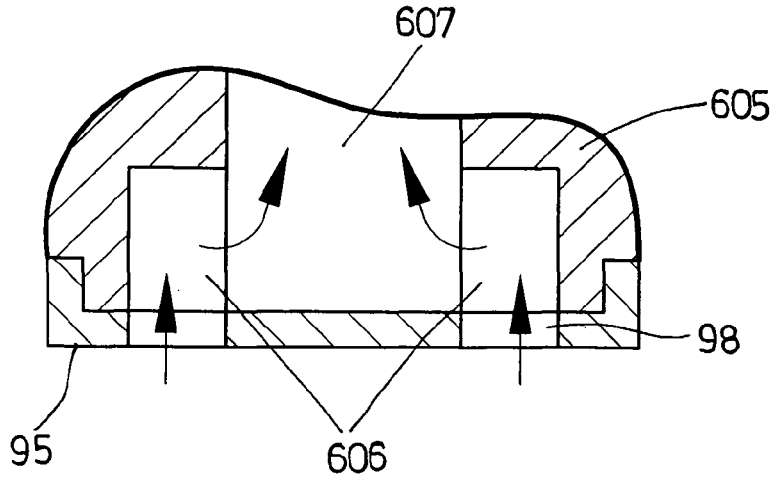
FIG. 11 is a partial cross sectional view taken along lines 10-10 of FIG. 10.
Figure 10:
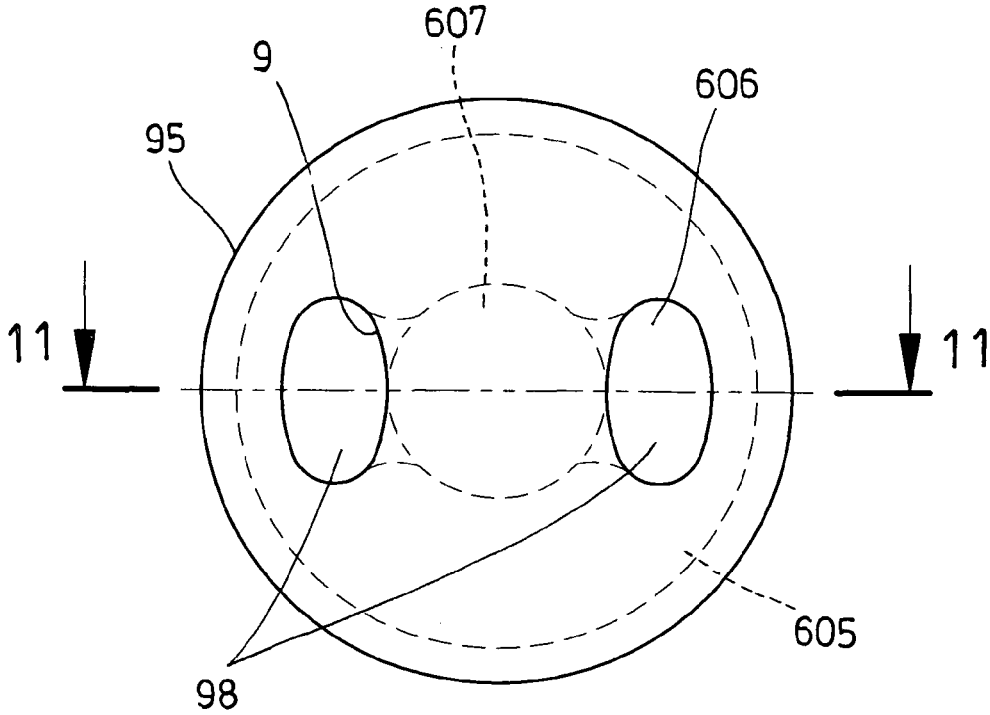
FIG. 10 is a partial plan schematic view illustrating the control valve device of the sprinkler as shown in FIG. 9.
Figure 13:
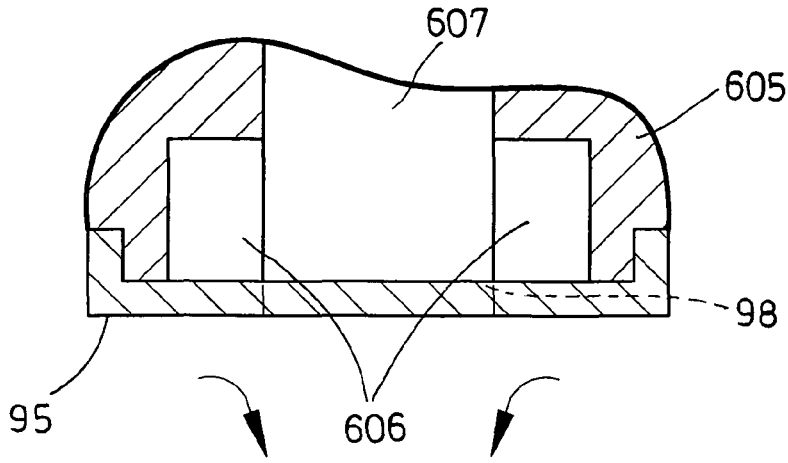
FIG. 13 is a partial cross sectional view taken along lines 13-13 of FIG. 12.
Figure 12:
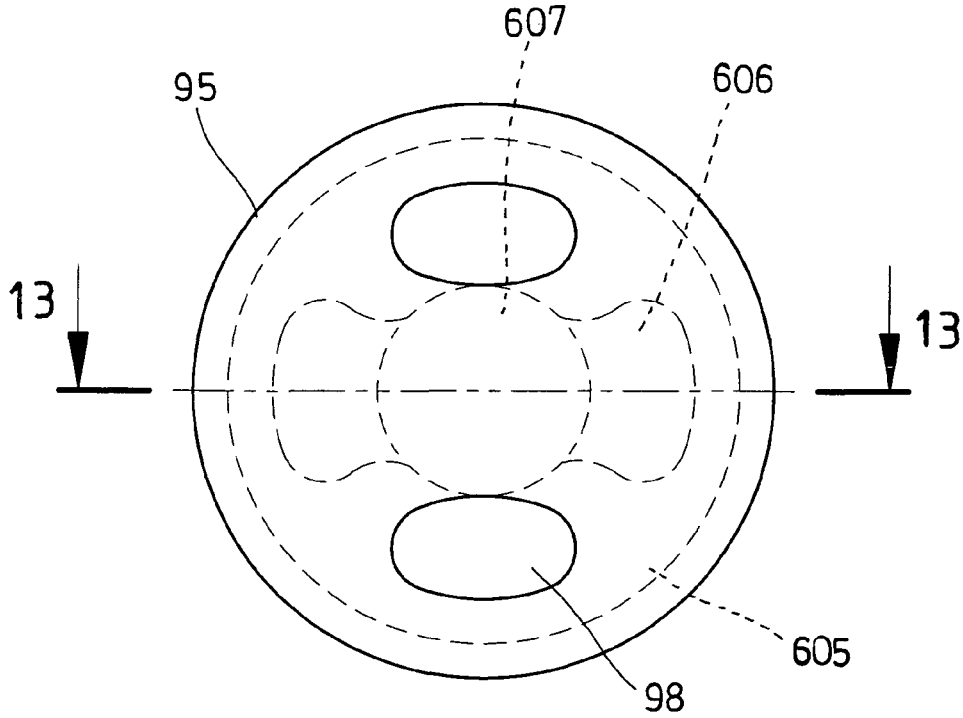
FIG. 12 is a plan schematic view similar to FIG. 10, illustrating the operation of the control valve device of the sprinkler as shown in FIGS. 9-11.

The control valve device 90 further includes another pinion or gear 97 attached to the rotary member 95 or extended from the rod 96 and engaged with the reduction gearing 40 (FIG. 2)

for allowing the rod 96 and the rotary member 95 to be rotated by the reduction gearing 40 and/or the paddle wheel 34, and further includes one or more (such as two) orifices 98 formed in the rotary member 95 for selectively aligning with the valve opening 93 of the valve piece 91 (FIGS. 5, 6) and for allowing the water to flow through the orifices 98 of the rotary member 95 and the valve opening 93 of the valve piece 91 and then to flow into the bore 601 of the shaft 60. The orifices 98 of the rotary member 95 may also be selectively aligned with the bulges 94 or selectively disengaged from the valve opening 93 of the valve piece 91 (FIGS. 7, 8) for preventing the water to flow through the orifices 98 of the rotary member 95 and the valve opening 93 of the valve piece 91 and thus for preventing the water from flowing into the bore 601 of the shaft 60.

It is to be noted that the valve piece 91 may be formed integral with the shaft 60 and may be a part or a portion of the shaft 60, and the valve opening 93 may be directly formed in the shaft 60. Alternatively, as shown in FIGS. 9-13, without the valve piece 91 as shown in FIGS. 2-8, the shaft 605 may include one or more (such as two) recesses 606 formed therein and communicating with the bore 607 of the shaft 605 for selectively aligning with the orifices 98 of the rotary member 95 (FIGS. 10, 11) and for allowing the water to flow through the orifices 98 of the rotary member 95 and the recesses 606 of the shaft 605 and then to flow into the bore 607 of the shaft 605.

In operation, the rotary member 95 may be rotated relative to the shaft 60 by the reduction gearing 40 and/or the paddle wheel 34, and the orifices 98 of the rotary member 95 may be caused to align with the valve opening 93 of the valve piece 91 or the recesses 606 of the shaft 605 intermittently and thus for allowing the water to flow out through the bore 601 of the shaft 60 or the bore 607 of the shaft 605 intermittently.

Accordingly, the sprinkler includes an oscillating mechanism for smoothly rotating or driving the sprinkler tube and for avoiding dead points to be occurred, and thus for allowing the water to smoothly or swiftly flow out of the sprinkler tube in various kinds of water spraying patterns, and includes a control valve device to control the water flowing through the central shaft of the sprinkler.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprinkler comprising:

an oscillating mechanism including a receptacle for receiving water, a casing rotatably attached to said receptacle and rotate relative to said receptacle, said receptacle including a container having a partition and a board to form a compartment therein between said partition and said board;

a first ratchet gear and a second ratchet gear rotatably received within said receptacle and rotating in different directions;

said casing including two pawls selectively engaged with said first and said second ratchet gears respectively to allow said casing to be rotated relative to said receptacle in different directions by said pawls and said first and said second ratchet gear respectively;

a barrel and a shaft rotatably received within said receptacle, and rotating in different directions, said first ratchet gear and said second ratchet gear being attached onto said barrel and said shaft respectively and rotating in concert with said barrel and said shaft respectively, said barrel and said shaft each including a first gear provided thereon, a paddle wheel rotatably received in said compartment in said container, said paddle wheel coupled to said barrel and said shaft for rotating said barrel and said shaft in different directions relative to said receptacle, said paddle wheel including a pinion secured thereon and rotating in concert therewith, a reduction gearing engaged with said pinion and engaged with said first gear of said shaft, and at least one idle gear engaged between said first gear and said barrel and said reduction gearing for allowing said barrel and said shaft to be rotated in different directions relative to said receptacle by said paddle wheel; and mean for controlling the water to flow through said shaft, said controlling means includes a valve opening formed in said shaft, and including a rotary member rotatably attached to said shaft and having at least one orifice formed in said rotary member for selectively aligning with said valve opening of said shaft and for intermittently allowing the water to selectively flow through said at least one orifice of said rotary member and said valve opening of said shaft and then to flow into a bore of said shaft, said rotary member including a second gear engaged with said reduction gearing for allowing said rotary member to be rotated by said reduction gearing and said paddle wheel, said rotary member including a rod extending therefrom, and said second gear disposed on said rod.

2. The sprinkler as claimed in claim 1, wherein said casing includes a plate having said pawls rotatably attached thereto, said pawls each includes a first end for engaging with said first and said second ratchet gears respectively.

3. The sprinkler as claimed in claim 2, wherein said casing includes a spring member engaged with said pawls, for biasing said first ends of said pawls to engage with said first and said second ratchet gears respectively.

4. The sprinkler as claimed in claim 2, wherein said casing includes an actuating device rotatably attached to said plate with a pivot axle, and includes two legs for engaging with said pawls and for forcing said first ends of said pawls to selectively engage with said first and said second ratchet gears respectively.

5. The sprinkler as claimed in claim 4, wherein said casing includes a swelling extended therefrom, said actuating device includes a spring biased projection engaged therein, and engaged with said swelling of said casing, for selectively positioning said first ends of said pawls in engagement with said first and said second ratchet gears respectively.

6. The sprinkler as claimed in claim 4, wherein said receptacle includes a first control ferrule and a second control ferrule attached to said receptacle, and each having an actuator extended therefrom for engaging with said actuating device, and for selectively forcing said first ends of said pawls to engage with said first and said second ratchet gears respectively.

7. The sprinkler as claimed in claim 6, wherein said receptacle includes a pin extended therefrom, said first and said second control ferrules each includes a curved channel formed therein, for slidably receiving said pin of said receptacle, and for limiting said first and said second control ferrules to rotate relative to said receptacle.

8. The sprinkler as claimed in claim 6, wherein said receptacle includes a sleeve extended therein, said first and said second control ferrules each includes a serrated surface formed therein, for engaging with said sleeve with a force-fitted engagement.

9. The sprinkler as claimed in claim 6, wherein said first and said second control ferrules each includes a knob extended outwardly therefrom, for allowing said first and said second control ferrules to be rotated and adjusted relative to said receptacle by user, in order to determine a rotating and swinging stroke of said casing and said sprinkler tube relative to said receptacle.

10. The sprinkler as claimed in claim 6, wherein said first control ferrule includes a curved slot formed therein, for slidably receiving said actuator of said second control ferrule, and for allowing said actuator of said second control ferrule to engage with said actuating device.

11. The sprinkler as claimed in claim 1, wherein said barrel and said shaft each includes a non-circular segment provided thereon for engaging with said first and said second ratchet gears respectively, and for allowing said first and said second ratchet gears to be rotated in concert with said barrel and said shaft respectively.

* * * * *